United States Patent [19]

Arnim, II et al.

[11] Patent Number: 4,510,985

[45] Date of Patent: Apr. 16, 1985

[54] STACKED OPEN BOTTOM TEMPORARY GUIDE BASE FOR OFFSHORE DRILLING

[75] Inventors: Robert C. Arnim, II, Borger, Tex.; Gregory D. Bourne, London, England

[73] Assignee: Phillips Petroleum Company, Bartlesville, Okla.

[21] Appl. No.: 534,060

[22] Filed: Sep. 20, 1983

[51] Int. Cl.[3] ..... E21B 7/128

[52] U.S. Cl. ..... 175/7; 175/10; 166/349; 405/205

[58] Field of Search ..... 175/7, 10; 166/339, 166/342, 344, 349, 350, 381; 405/204, 205, 209, 171

[56] References Cited

U.S. PATENT DOCUMENTS

| | | | |
|---|---|---|---|
| 2,217,879 | 10/1940 | Willey . | |
| 3,554,277 | 1/1971 | Bauer et al. | 166/344 |
| 3,605,414 | 9/1971 | Westmoreland, Jr. . | |
| 3,719,048 | 3/1973 | Arne et al. | 405/210 |
| 3,782,460 | 1/1974 | Skinner . | |
| 3,849,994 | 11/1974 | Seabourn . | |
| 3,919,850 | 11/1975 | Coone et al. . | |
| 4,083,193 | 4/1978 | Evans . | |
| 4,167,215 | 9/1979 | Thorne | 175/7 |
| 4,273,471 | 6/1981 | Burke | 405/205 |

FOREIGN PATENT DOCUMENTS

| | | | |
|---|---|---|---|
| 0009528 | 1/1981 | Japan | 405/205 |

*Primary Examiner*—Stephen J. Novosad
*Assistant Examiner*—William P. Neuder
*Attorney, Agent, or Firm*—French and Doescher

[57] ABSTRACT

A temporary guide base for use in drilling underwater wells in areas where the bottom conditions are unstable comprises a plurality of boxes opened at the bottom having a centrally disposed hole for casing, and vent means to allow retrieval of the guide bases without causing a suction effect, the guide bases being open to the sea on the bottom to fill the sea water but float in the mud on the bottom.

19 Claims, 7 Drawing Figures

STACKED OPEN BOTTOM TEMPORARY GUIDE BASE FOR OFFSHORE DRILLING

BACKGROUND OF THE INVENTION

This invention relates to temporary guide bases for underwater drilling operations.

It has long been recognized that many valuable petroleum deposits lie beneath the lakes and ocean coastlines and in recent years substantial technology has developed relative to drilling in underwater environments. These operations involve many problems and in instances where the ocean or lake bed is soft and muddy, these problems are made even more pronounced. For over forty years, technology has existed to utilize a submersible foundation hull or barge for drilling into water covered ground as evidenced by Willey, U.S. Pat. No. 2,217,879 (Oct. 15, 1940). Willey describes a submersible foundation having a system of piping so as to allow the compartments to fill with water to submerge the device and to pump air or other vaporous material into the device to displace water so as to float it to the surface again where it can be towed to a new location. The only practical way to transport such a large box in the absence of extremely large and expensive ships is to tow the device to the site.

SUMMARY OF THE INVENTION

It is an object of this invention to provide a temporary guide base which can be easily handled;

It is a further object of this invention to provide a temporary guide base especially suited for use where the ground under the water is soft;

It is yet a further object of this invention to facilitate drilling in offshore areas having soft or muddy ground at the drilling location.

It is yet a further object of this invention to provide a temporary guide base which can be easily installed and easily removed.

In accordance with this invention, a temporary guide base is comprised of a plurality of vented open bottomed boxes stacked one above the other.

BRIEF DESCRIPTION OF THE DRAWINGS

In the drawings forming a part hereof wherein like reference characters denote like parts in the various views.

DESCRIPTION OF THE PREFERRED EMBODIMENTS

Figure 1:
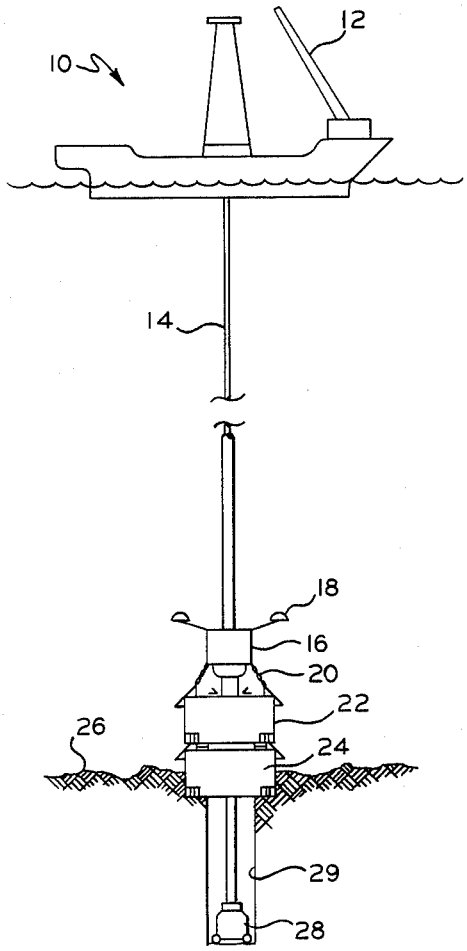
FIG. 1 is a schematic representation of a drilling operation utilizing the temporary guide base of the instant invention.

Referring now to the drawings, a ship 10 having a centrally disposed opening called a moonpool fitted with a crane 12 for moving items above the moonpool is positioned over a drilling site with a drill string 14 shown extending through the moonpool to a guidelineless re-entry system (GRA) 16 having sensing means 18 which can be TV cameras, sonar or other sensing devices. GRA 16 is attached by chains 20 to the upper temporary guide base 22. Lower guide base 24 is shown embedded in the soft mud 26 with drill bit 28 shown in hole 29. As reference is made herein to a floating guide base, it is meant that the guide base 24 and associated members such as member 22 "float" in the mud. Lower guide base 24 is open on the bottom and is essentially filled with sea water as is upper guide base 22. Thus the floating guide base is heavier than water and floats, not in the water, but in the mud, the base assembly having a density greater than that of the sea water which is generally about 64 lbs. per cubic foot. Of course, the depth to which the box will sink into the mud is both a function of the density of the mud and the shear strength of the mud.

Figure 2:
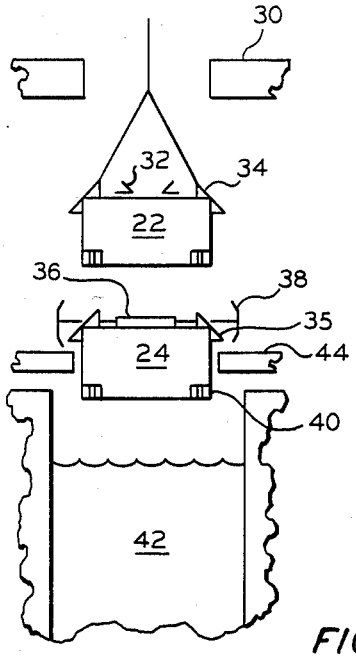
FIG. 2 is a side view showing the assembly of the boxes above a moonpool.
Figure 6:
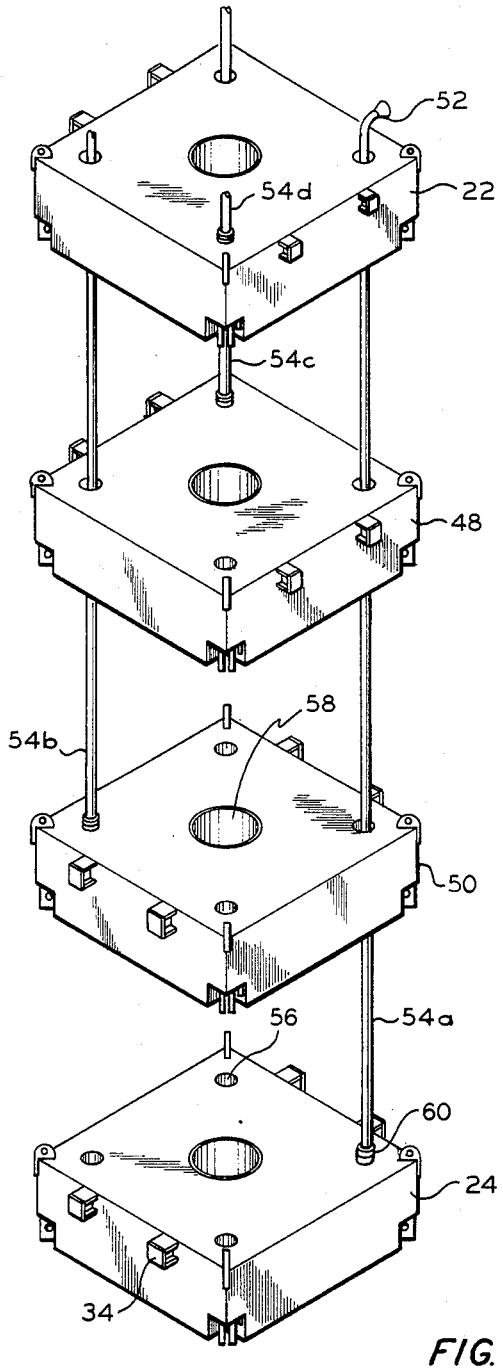
FIG. 6 is a view of the assembly of the temporary guide bases in greater detail.

Referring now to FIG. 2, there is shown rig floor 30 from which upper guide base 22 is suspended by attachment to top padeyes 34. Bottom guide base 24 is held up by means of landing padeyes 35. Seal pad 36 provides a positive seal around the central hole 58 (FIG. 6). Depending on the shear strength of the mud and whether or not the top box actually sinks into the mud, a seal at the top of the top box may not be necessary. Guidance bumpers 38 are designed to centralize the box in the moonpool 42. The bumpers are slotted to slip over the top padeyes of the lower boxes and to be trapped in place by the clevis padeyes of the upper boxes.

The landing padeyes 35 are designed to take the load of a plurality of boxes, up to 4 or more, the re-entry apparatus and up to 300 ft. or more of 30 inch or larger casing without yielding the padeye or any portion of the box structure. The boxes have padeyes at each top corner and clevis padeyes at each bottom corner. The top padeyes are used for handling and attaching the re-entry apparatus as will be discussed in greater detail hereinbelow. The top padeyes of one box mate with the clevis padeyes of a second box and the boxes are attached for instance by means of a 3 inch diameter pin at each corner which connects the boxes firmly together. A central hole can simply be made of pipe of slightly larger diameter than that necessary for running the jetting and casing strings. The boxes are open to the sea at the bottom but are water tight everywhere else. Access into the top of each box is provided by a valve means such as swingcheck valve 52 (FIG. 6), that when held open, allows air to be vented when the box is submerged. The swingcheck then allows water to flow into the box to help break suction effects when the box is pulled free from the mud.

Figure 3:
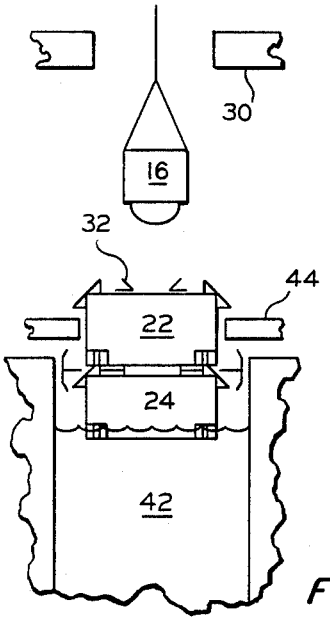
FIG. 3 is a side view showing the attachment of a re-entry device to the temporary guide base.

Referring now to FIG. 3, guide bases 22 and 24 are shown connected and guidelineless re-entry apparatus 16 position thereabove. To allow the GRA to gimble on the top box, a modified Vetco gimble bolts onto the top flange of the uppermost box. The bolt circle in the top flange may also be used to attach a drive pipe if so desired. The seal pad or rubber mat 36 (as shown in FIG. 2) is shown between the pair of boxes. This acts as a partial seal between the boxes and the casing which is subsequently introduced.

Further with regard to the sequence of steps as shown in FIGS. 2 and 3, with the rotary table section (FIG. 4) removed, the first box is brought into the moonpool area and set on the spider beams 44. The seal pad is positioned on the top of the box and glued in place with contact cement, for instance. The bumpers are settled over the padeyes. The second box is brought in and lowered onto the first box and pinned to it. Both are then lowered to hang from the top box. The gimble is then bolted to the top box and the vent pipes and swingchecks installed. The swingchecks are pegged open until the boxes are submersed.

Figure 4:
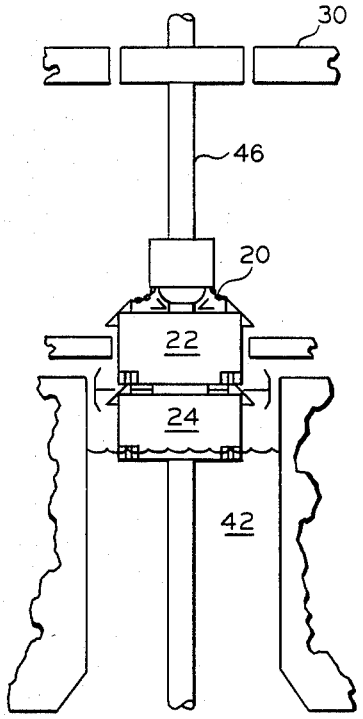
FIG. 4 is a side view showing the running of a 30 inch casing string prior to lowering the temporary guide base.
Figure 5:
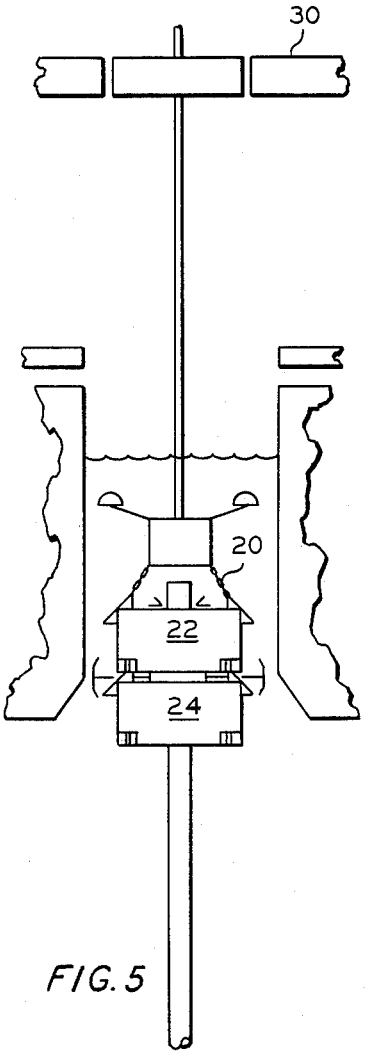
FIG. 5 is a side view showing the running of the temporary guide bases to the seabed.

Referring now to FIG. 4, the GRA is brought in, positioned and chained to the top padeyes by means of attachment chain 20. The chains are sized to allow the weight of the boxes to hang from two chains with a safety factor of 5:1 when the chains are set at 45°. The chains, chain lengths and attachment shackles are designed to break if a sufficient load is applied. Thus, if the boxes become stuck in the mud, at least the GRA can be recovered after shooting off the casing strings. The chains and the top padeyes become a guide in the moonpool when recovering the GRA and boxes. A second possible way of breaking free depends on the strength of the box attachment pins. If it is desirable to leaving buried boxes below the seabed, then the attachment pins can be machined down to become shear pins. After replacing the rotary table section and V-door, the casing is run through the GRA and boxes with the housing landing out in the GRA. The guide means such as TV cameras, sonar reflectors or other electronic guide means are then attached to the GRA. The whole assembly is then run below sea level as shown in FIG. 6. When the air has finished venting from the boxes, the check valve pegs are pulled free and the string run to seabed for jetting.

The procedure when it is desired to recover the boxes is as follows: After shooting off the casing strings, pumps are turned on to help wash out the formation holding the boxes. The seal is to stop vertical flow between the casing and boxes and to facilitate cratering. Upward pull is exerted which causes a small vacuum within the boxes thus opening check valve 52 to allow water to flow through the boxes to the void created in the mud.

FIG. 6 shows an exploded view of floating box alignment wherein four boxes are assembled together. The boxes can be identical and simply have each rotating 90° so as to utilize four identical access to 56 in the four corners with vent pipes 54*a, b, c,* and *d* being connected respectively to boxes 24, 50, 48, and 22 by means of vent couplings 60. Alternatively, a single vent pipe can be used for all the boxes with an opening into the vent pipe in each box through which it passes.

There can be considerable variation in the size of the individual boxes but in general each individual box will be considerably less than the 10 ft. or so in height which is employed in many conventional boxes. Boxes of 3 to 7 ft., preferably 4 to 6 ft. in height are particularly suitable by virtue of being small enough in height to be easily handled and yet requiring only 2 or 3 or 4 at the most to provide adequate buoyancy in the soft mud. The length and width dimensions can be varied considerably depending on the size of the moonpool, generally these dimensions will be in the range of 5 to 20 ft., preferably 12 to 15 ft. While they will generally be square and symmetrical as shown in the drawings, a rectangular configuration where the length is greater than the width is also possible as is a round configuration. Construction materials of the boxes can be the same as that for boxes conventionally used will generally be of steel although reinforced fiberglass and other conventional construction material can be used for part or all of the construction.

Figure 7:
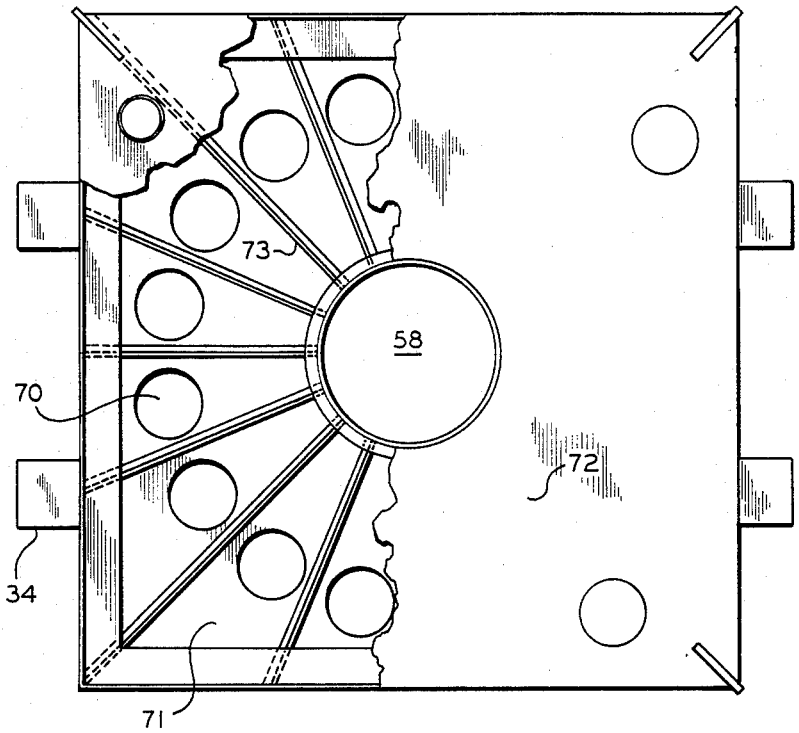
FIG. 7 is a top view of one of the boxes with part of the top plate removed.

Referring to FIG. 7 with part of the top plate removed for clarity, by "open at the bottom" is meant that the boxes of this invention have open communication with the sea so that water can flow into the boxes through holes 70 in bottom plate 71 for instance, not only the bottom box but each box above it, the water coming in through the space between the two boxes and through the openings 70 in the bottom. FIG. 7 also illustrates top plate 72 and reinforcing members 73. Generally, a space of 0.5 to 5, more generally about 1 inch is provided between boxes by virtue of the size of the padeyes which connect the boxes. Then on removal from the mud, the water can flow in through the valve just above the uppermost box which preferably has a check valve so that it automatically opens whenever an effort is made to lift the box thus creating a small suction within the box thereby allowing water to flow in through the valve and through the boxes into the void created by the lifting of the boxes so as to avoid a suction effect. Preferably, the boxes are essentially entirely open inside except for necessary framework to give structural stability. The boxes however are sealed around the central pipe and thus at the uppermost box with a solid top and the seal around the pipe, the material inside the box cannot flow out through the top.

EXAMPLE

A pair of steel boxes substantially as shown in the drawings were constructed of structural steel having a dimension of 14.6 ft. × 14.6 ft. × 5 ft. high. The following calculations were used in determining the need for two boxes.

DATA

| | | |
|---|---|---|
| Total Weight for Assembly in Seawater | 135,000 | lbs. |
| Length 30" casing below box | 90 | feet |
| Box dimension | 14.6 × 14.6 | feet |
| Circumference 30" conductor | 7.85 | feet |
| Area 30" conductor | 4.91 | $ft^2$ |
| Area Box - Area Conductor | 208 | $ft^2$ |
| Average Shear Strength | 58.7 | psf |
| Ooze Shear Strength | 42.0 | psf |
| Density Seawater | 64 | pcf |
| Density Ooze | 87 | pcf |

FORMULAE

Wt. to be suspended = Buoyancy + bearing capacity + shear on conductor + Shear on Floating box $$W = AD\Delta\rho + 7.4\,\tau_{ooze}A + LC_c\tau_{av} + DC_b\tau_{ooze}$$

SOLVE for D $$D = \frac{W - 7.4\tau_{ooze}A - LC_c\tau_{av}}{A\Delta + C_{b\,ooze}}$$

$$D = \frac{135{,}000 - 7.4(42)(208)\ 90(7.85)(58.7)}{208(23) + 58.4(42)}$$

$$D = \frac{28882.05}{7236.8}$$

D = 3.99 feet

Definition of Terms

W = Weight to be suspended
D = Depth of floating box penetration
Δ = Difference between seawater and ooze densities
7.4 = Empirical factor for square footings
ooze = Shear strength of seabed ooze
av = Average shear strength of sub seabed sediments
L = Length 30" conductor below floating -continued box
$C_c$ = Circumference of 30" conductor
$C_b$ = Circumference of floating box The boxes were carried on a ship to an offshore drilling site where they were assembled as shown in the drawings and lowered to the ocean floor and used in the actual drilling of an oil well and thereafter recovered intact for subsequent use. The overall bulk density of each box when filled with seawater was approximately 88 lbs per cubic foot. Generally the density for these boxes will be in the range of 85–100 lbs. per cubic foot.

While this invention has been described in detail for the purpose of illustration, it is not to be construed as limited thereby but is intended to cover all changes and modifications within the spirit and scope thereof.

What is claimed is:

1. A temporary guide base assembly comprising:

(a) at least one lower box having vent pipe means and having a central hole adapted to receive casing, said at least one lower box being closed on the sides and top except for said central hole and being open at the bottom;

(b) an upper box in stacked relationship with said at least one lower box, said upper box having vent pipe means and having a central hole adapted to receive casing, said upper box being closed on the sides and top except for said central hole and being open at the bottom; and (c) a seal pad around said central hole of each of said at least one lower boxes.

2. An apparatus according to claim 1 wherein said upper box is essentially identical to said at least one lower box.

3. An apparatus according to claim 1 wherein said vent pipe means of said at least one lower box and said upper box comprise pipes in communication with their respective boxes and terminating in valve means above the uppermost of said boxes.

4. An apparatus according to claim 3 wherein said valve means is a check valve which is normally closed to prevent fluid from escaping upwardly out of the respective box and which opens automatically to allow fluid to flow down into and through the respective box to prevent a suction effect when said assembly is lifted from under water floor.

5. An apparatus according to claim 1 wherein said assembly is made up of two boxes.

6. An apparatus according to claim 5 wherein said two boxes are essentially identical.

7. An apparatus according to claim 1 wherein said assembly is made up of three boxes.

8. An apparatus according to claim 1 wherein each of said boxes has a height of 4 to 6 feet.

9. An apparatus according to claim 1 wherein said seal pad comprises a rubber gasket sealed to the surface of the lower of the two boxes being joined and having an opening smaller than said centrally disposed hole in said lower of the boxes being joined, said gasket being adapted to fit tightly around casing when it is inserted.

10. An apparatus according to claim 1 comprising in addition a re-entry device attached to the uppermost of said boxes.

11. An apparatus according to claim 10 wherein said re-entry device has associated therewith a sensing means to allow guideless re-entry of drilling equipment.

12. An apparatus according to claim 1 wherein said temporary guide base assembly filled with water has a density within the range of 85 to 100 lbs. per cubic foot.

13. A temporary guide base assembly comprising:

(a) a lower box having a vent pipe means in open communication with the interior through an upper surface thereof and having a central hole adapted to receive casing, said box being closed on the sides and top except for said central hole and being open at the bottom;

(b) an upper box in stacked relation with said lower box, said upper box having a vent pipe means attached to an upper surface thereof in open communication with the interior thereof and a central hole adapted to receive casing, said upper box being closed on the sides and top except for said central hole and being open at the bottom; and (c) sealing means adhered to the upper surface of said lower box and adapted to seal around casing when inserted through said holes.

14. An apparatus according to claim 13 comprising in addition a re-entry means attached to said upper box.

15. An apparatus according to claim 14 wherein said vent means associated with said lower box comprises a pipe extending from said lower box through said upper box and terminating above said upper box in a valve means and wherein said vent pipe means associated with said upper box comprises a short pipe attached to said upper box and terminating in a valve means.

16. An apparatus according to claim 15 wherein said valve means is a check valve which is normally closed to prevent fluid from flowing upwardly and which opens to allow fluid to flow downwardly to prevent a suction effect when said assembly is lifted out of soft soil.

17. A process for constructing a temporary guide base below on the floor beneath a body of water comprising:

(a) positioning over a moonpool in a ship a first temporary guide base box having vent pipe means and having a centrally disposed hole adapted to receive casing, said box being closed on the sides and top except for said central hole and being opened at the bottom;

(b) affixing a sealing means on said top around said hole;

(c) positioning in stacked relation at least one second temporary guide base box around said first temporary guide base box, said second temporary guide base box having vent pipe means and a central hole adapted to receive drill casing, said second temporary guide base box being closed on the sides and top except for said central hole and being open at the bottom; and (d) lowering said thus assembled temporary guide base assembly to the floor beneath the body of water with said vent means in open communication between the interior of the respective box and the water until said boxes are filled with water.

18. A method according to claim 17 wherein prior to lowering said temporary guide base assembly, a re-entry means is affixed to the upper of said at least one additional temporary guide base boxes.

19. A temporary guide base assembly comprising:

(a) four boxes in stacked relationship each of which is essentially symmetrical and essentially identical, with vent pipe means being disposed in each of the four corners of an uppermost of said boxes, the vent pipe means to said uppermost box being in a first corner, the vent pipe means to a second box being in a second corner, going through said first box to said second box, the vent pipe means in a third box from the top being in a third corner and going through said first and second boxes to said third box and the vent pipe means to a fourth box being in a fourth corner going through said uppermost, second and third boxes and attaching to said lower box, said boxes each having a central hole adapted to receive casing, said boxes being closed on the sides and top except for said central hole and being open at the bottom; and (b) sealing means around said central hole of each said box below said uppermost box.

* * * * *